US006485267B1

(12) United States Patent
Imai et al.

(10) Patent No.: US 6,485,267 B1
(45) Date of Patent: Nov. 26, 2002

(54) CONTROL VALVE FOR VARIABLE CAPACITY COMPRESSORS

(75) Inventors: Masayuki Imai; Toshiki Okii; Yoshiyuki Kume, all of Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 09/671,076

(22) Filed: Sep. 27, 2000

(30) Foreign Application Priority Data

Oct. 4, 1999 (JP) ..... 11-282877

(51) Int. Cl.[7] ..... F04B 1/26
(52) U.S. Cl. ..... 417/222.2
(58) Field of Search ..... 417/222.2, 295, 417/269; 251/61.5, 129.02, 129.07, 129.15; 62/228.1, 228.3, 228.5, 196.1, 196.3

(56) References Cited

U.S. PATENT DOCUMENTS 5,964,578 A * 10/1999 Suitou et al. ..... 417/222.2
6,234,763 B1 * 5/2001 Ita et al. ..... 417/222.2
6,263,687 B1 * 7/2001 Ban et al. ..... 62/228.3

FOREIGN PATENT DOCUMENTS

JP 0 919 720 A2 * 6/1999 ..... F04B/27/18

* cited by examiner

*Primary Examiner*—Charles G. Freay
*Assistant Examiner*—Han L Liu
(74) *Attorney, Agent, or Firm*—Baker Botts L.L.P.

(57) ABSTRACT

A control valve for a variable capacity compressor, which comprises a solenoid magnetization portion disposed at a central portion, a main body disposed on one side of the solenoid magnetization portion, and a pressure sensitive portion disposed on the other side of the solenoid magnetization portion. The main body comprises a discharge coolant port communicating with a discharge pressure region of the variable capacity compressor, a first intermediate coolant port communicating with a first intermediate pressure region, a suction coolant port communicating with a suction pressure region, and a second intermediate coolant port communicating with a second intermediate pressure region of the variable capacity compressor.

4 Claims, 8 Drawing Sheets

Prior Art

CONTROL VALVE FOR VARIABLE CAPACITY COMPRESSORS

BACKGROUND OF THE INVENTION

The present invention relates to a control valve for a variable capacity compressor to be employed in air conditioners for vehicles, etc., and in particular to a control valve for a variable capacity compressor, which is designed to supply, upon requirements, a coolant gas from a discharge pressure region to an intermediate pressure region.

A variable capacity compressor is generally provided with a cylinder, a piston, a wobble plate, etc., and is employed for compressing and discharging a coolant gas in an air conditioner of vehicles. There is known a variable capacity compressor comprising a coolant gas passage for communicating a discharge pressure region with a crankcase, and designed such that the quantity of coolant gas to be discharged can be changed in conformity with changes in inclination angle of the wobble plate which can be effected through an adjustment of the pressure inside the crankcase. The adjustment of pressure inside the crankcase is performed by feeding a high pressure compressed coolant gas from the discharge pressure region to the crankcase while adjusting the opening degree of a control valve disposed at an intermediate portion of the coolant gas passage.

As one example of the aforementioned control valve, a control valve 100' for a variable capacity compressor (hereinafter referred to simply as a control valve) as shown in FIG. 8 is known (see Japanese Patent Unexamined Publication (Kokai) H11-218078). This control valve 100' is disposed neighboring on the rear housing 3 of the variable capacity compressor 1 and is airtightly placed inside space 84 of the rear housing 3, the airtightness thereof being effected by means of O-rings 121*a*', 121*b*' and 131*b*'.

As shown in FIG. 8, this control valve 100 ' is constituted by a main body 120', solenoid magnetization portion 130' and pressure sensitive portion 145', wherein the solenoid magnetization portion 130' is disposed at the center, and the main body 120' and pressure sensitive portion 145' are respectively disposed on both sides of the solenoid magnetization portion 130'.

The solenoid magnetization portion 130' is provided on the outer circumference thereof with a solenoid housing 131', in which a solenoid 131A', a plunger 133' to be moved up and down by the magnetization of solenoid 131A', and a suction member 141' are housed. A plunger chamber 130*a*' housing the plunger 133' is communicated with suction coolant port 129' attached to the main body 120'.

The pressure sensitive portion 145' is disposed below the solenoid housing 131' and is provided therein with pressure sensitive chamber 145*a*', in which a bellows 146' and a spring 159' which are designed to actuate plunger 133' via a stem 138' are positioned.

The main body 120' is provided with valve chamber 123', and a ball valve 132' to be actuated by the plunger 133' through a push rod 135' is disposed inside the valve chamber 123', to which a coolant gas of high discharge pressure Pd is designed to be introduced. The valve chamber 123' is provided at the bottom surface thereof with a valve bore 125' communicating with a crankcase coolant port 128', and the upper space of the valve chamber 123' is closed by means of a stopper 124'. This stopper 124' is provided at the central portion thereof with a discharging coolant-introducing port 126*a*' and also provided at the bottom portion thereof with valve-closing spring 127' for urging the valve 132' to move toward the bottom side of the valve chamber 123'.

The main body 120' is further provided with a port 114' which is communicated via a passageway 57 with a crankcase constituting an intermediate pressure region of the compressor 1 and also with a chamber pressure Pc of the crankcase. Therefore, when the valve bore 125' is opened by means of the valve 132', a high-pressure coolant gas that has been introduced into the valve chamber 123' is allowed to be introduced via the port 114' and the passageway 57 into crankcase. The suction coolant port 129' which is communicated via a passageway 80 with a suction pressure region of the compressor 1 and is designed to receive a suction pressure Ps of the suction pressure region is not only communicated with the pressure sensitive chamber 145*a*', but also communicated with a suction pressure-introducing space 85 formed between the rear housing 3 and the solenoid housing 131'.

The plunger 133' disposed inside the solenoid housing 131' is slidably sustained by a pipe 136', which is air-tightly contacted via a couple of O-rings 134*a*' and 134*b*' with one end of the main body 120'. Further, a valve-opening spring 144' for urging the plunger 133' to move away from the suction member 141' is interposed between the plunger 133' and the suction member 141'. Out of a pair of stoppers 147' and 148' disposed inside the bellows 146' arranged inside pressure sensitive chamber 145*a*', only the stopper 147' is attached to the lower end 138*b*' of the stem 138', thereby enabling the stopper 147' to move close to or away from the stopper 148'. Additionally, a spring 150' for urging the stopper 147' to move away from the suction member 141' is interposed between the stopper 147' and the suction member 141'.

The pipe 154' functions to form the pressure sensitive chamber 145*a*' and is air-tightly secured via an 0-ring 156' to the solenoid housing 131', and an adjusting screw holder 152' is fixedly fitted in this pipe 154'. This adjusting screw holder 152' is provided therein an adjusting screw 156' for adjusting the strength of the bellows 146'. The adjusting screw 156' is air-tightly contacted via an 0-ring 157' with the adjusting screw holder 152' and the distal end thereof is contacted with the stopper 148' of the bellows 146'.

By the way, a cord 158' for supplying a predetermined magnetization current that will be controlled by a controlling computer (not shown) is connected with the solenoid 131A'.

When solenoid 131A' of control valve 100' is magnetized, the plunger 133' is pulled toward the suction member 141' against the urging force of the valve-opening spring 144', thereby causing the push rod 135' connected with the plunger 133' to move. As a result, the valve 132' is moved in the direction to close the valve bore 125' of the main body 120'. When the suction pressure Ps inside the pressure sensitive chamber 145*a*' becomes higher, bellows 146' is forced to contract in conformity with the suction pressure Ps, so that the direction of this shrinkage becomes identical with the sucking direction of the plunger 133' to be effected by the solenoid 131A'. This displacement of bellows 146' is followed by the valve 132', thereby reducing the opening degree of the valve bore 125'. As a result, the quantity of high-pressure coolant gas to be introduced into the crankcase through the port 114' and passageway 57 after being introduced into the interior of the valve chamber 123' via the discharging coolant-introducing port 126*a*' from the discharge pressure region is caused to decrease (crankcase pressure Pc is lowered), thereby increasing the angle of inclination of the wobble plate of the compressor 1. Whereas, when the suction pressure Ps inside the pressure sensitive chamber 145a' becomes lower, bellows 146' is forced to expand due to a spring 159' and also to the restoring force of the bellows itself, so that due to the displacement of the bellows 146', the valve 132' is pushed by the stem 138' and the plunger 133', thereby causing the valve 132' to move in the direction to increase the opening degree of the valve bore 125'. As a result, the quantity of high-pressure coolant gas to be introduced into the crankcase from the passageway 57 through the port 114' and after being introduced into the interior of the valve chamber 123' via the stopper 124' from the discharge pressure region is caused to increase (crankcase pressure Pc is raised), thereby decreasing the angle of inclination of the wobble plate.

On the other hand, when the solenoid 131A' is demagnetized, the pulling of the plunger 133' toward suction member 141' is diminished, so that due to the urging force of the valve-opening spring 144', the plunger 133' is caused to move in the direction away from the suction member 141', thereby causing the valve 132' to move, through the push rod 135', in the direction to open the valve bore 125' of the main body 120'.

By the way, the aforementioned conventional control valve 100' is constructed such that as shown in FIG. 8, a low temperature coolant gas that has been introduced into the pressure sensitive chamber 145*a*' of the main body 120' from the suction pressure region is then introduced into the suction pressure-introducing space 85 interposed between the solenoid housing 131' and the rear housing 3. In this case, since the suction pressure-introducing space 85 is air-tightly closed through the O-ring 131*b*' placed on the sidewall of the solenoid housing 131', the sidewall of the solenoid housing 131' can be cooled entirely, so that the temperature of solenoid 131A' inside the solenoid housing 131' can be suppressed from being raised, thus making it possible to suppress the deterioration of magnetization force.

However, for the purpose of enabling a difference in pressure between a high discharging pressure and an intermediate pressure to be effectively utilized by the compressor 1, it is required to introduce the aforementioned high discharge pressure Pd not only into the crankcase constituting a first intermediate pressure region but also into a second intermediate pressure region constituting another intermediate pressure region. However, the aforementioned conventional control valve 100' is suited for securing this second intermediate pressure Pc'.

With a view to overcome the aforementioned problems, the present inventors have already proposed various kinds of invention on a control valve for a variable capacity compressor (for example, Japanese Patent Application H10-295492 and H10-367979). However, any particular consideration is not taken into account in these control valves on the idea that a discharge pressure from a variable capacity compressor is introduced not only into a first intermediate pressure region, but also into a second intermediate pressure region, thereby making it possible to effectively utilize also a difference in pressure between a high discharge pressure and an intermediate pressure.

BRIEF SUMMARY OF THE INVENTION

The present invention has been made under the circumstances mentioned above, and therefore an object of the present invention is to provide a control valve for a variable capacity compressor, wherein a discharge pressure from a variable capacity compressor is introduced not only into a first intermediate pressure region, but also into a second intermediate pressure region, thereby making it possible to effectively utilize also a difference in pressure between a high discharge pressure and an intermediate pressure.

With a view to achieve the aforementioned object, the present invention provides a control valve for a variable capacity compressor, which essentially comprises a solenoid magnetization portion disposed at a central portion, a main body disposed on one side of said solenoid magnetization portion, and a pressure sensitive portion disposed on the other side of said solenoid magnetization portion, wherein said main body comprises a discharge coolant port communicating with a discharge pressure region of said variable capacity compressor, a first intermediate coolant port communicating with a first intermediate pressure region, a suction coolant port communicating with a suction pressure region, and additionally, a second intermediate coolant port communicating with a second intermediate pressure region of said variable capacity compressor.

According to the control valve for a variable capacity compressor of the present invention, it is possible to introduce a high discharge pressure Pd into a second intermediate pressure region, thereby making it possible to reliably respond to the demand for the effective utilization of not only a pressure difference between the high discharge pressure Pd and the first intermediate pressure Pc but also a pressure difference between the high discharge pressure Pd and the second intermediate pressure Pc'.

According to a preferable embodiment of the control valve for a variable capacity compressor of the present invention, said main body comprises a first valve for opening or closing said discharge coolant port and said first intermediate coolant port, and a second valve for opening or closing said discharge pressure region and said second intermediate coolant port. According to another preferable embodiment of the control valve for a variable capacity compressor of the present invention, said second valve is designed such that said second valve is capable of closing said discharge pressure region and said second intermediate coolant port before said discharge coolant port and said first intermediate coolant port are closed by said first valve.

According to a further preferable embodiment of the control valve for a variable capacity compressor of the present invention, it further comprises a valve chamber having a valve bore at the bottom surface thereof, wherein said first valve is disposed inside said valve chamber and is designed to be actuated by a plunger of said solenoid magnetization portion, and said second valve is actuated following the movement of said plunger.

BRIEF DESCRIPTION OF THE SEVERAL VIEWS OF THE DRAWING

7B is a graph illustrating the flow rate of the control valves shown in FIGS. 1 and 5.

DETAILED DESCRIPTION OF THE INVENTION

One embodiment of a control valve for a variable capacity compressor according to the present invention will be explained with reference to the drawings. By the way, the constituent components having the same feature as the prior art will be identified by the same reference number as that of the prior art.

Figure 1:
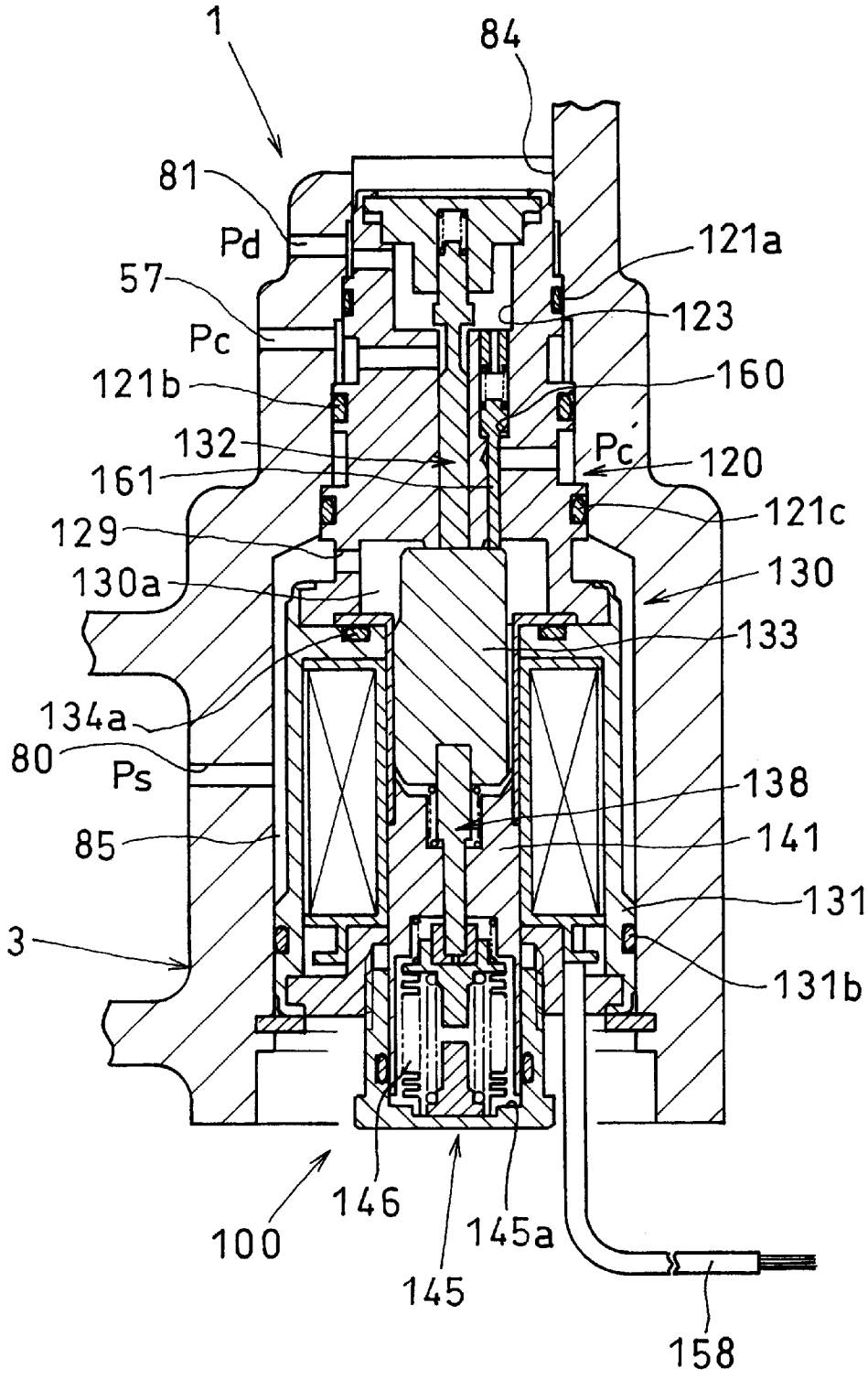
FIG. 1 is a longitudinal sectional view of a control valve for a variable capacity compressor according to a first embodiment of the present invention.
Figure 2:
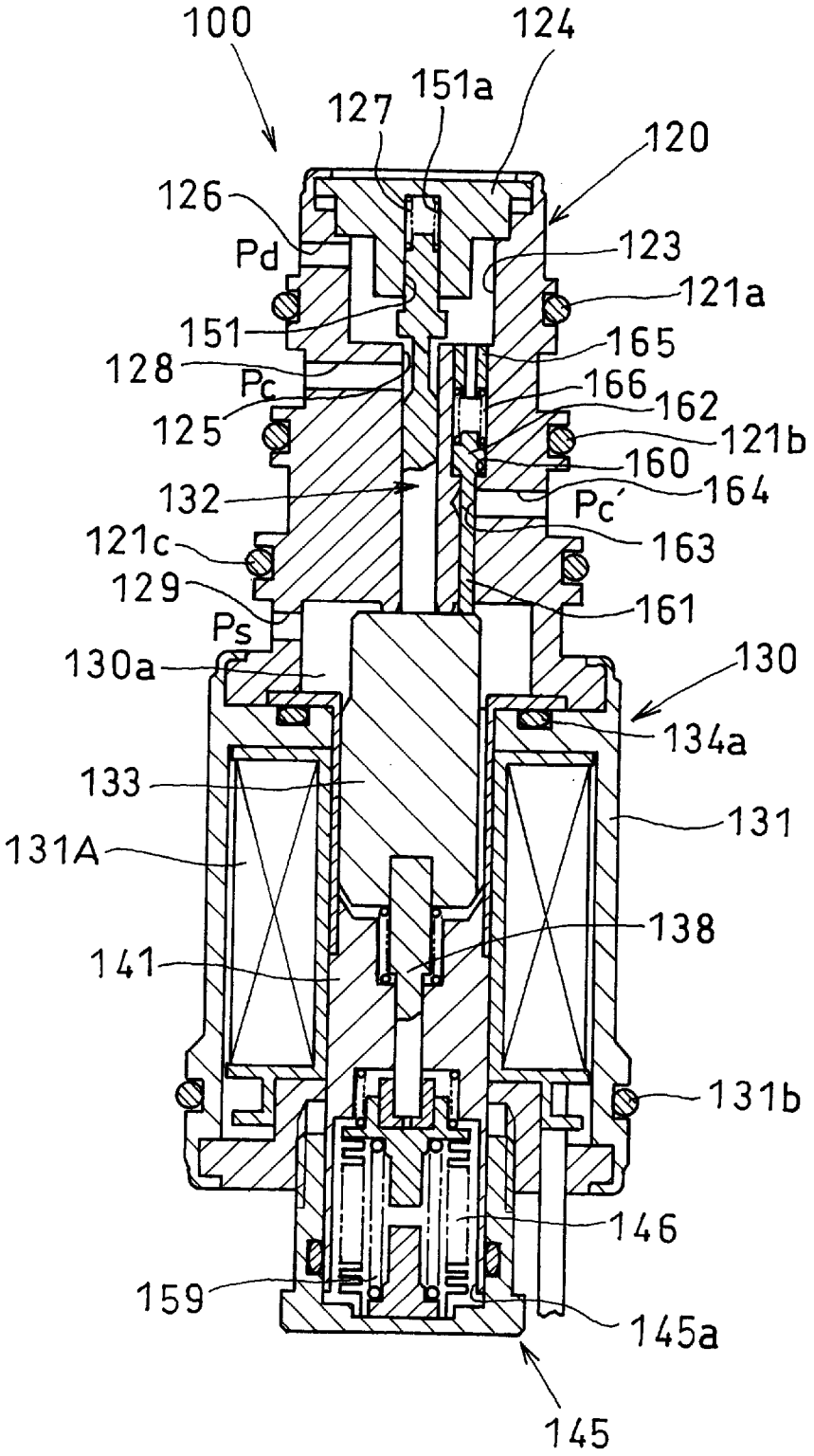
FIG. 2 is a longitudinal sectional view shown in detail of a control valve for a variable capacity compressor shown in FIG. 1.
Figure 3:
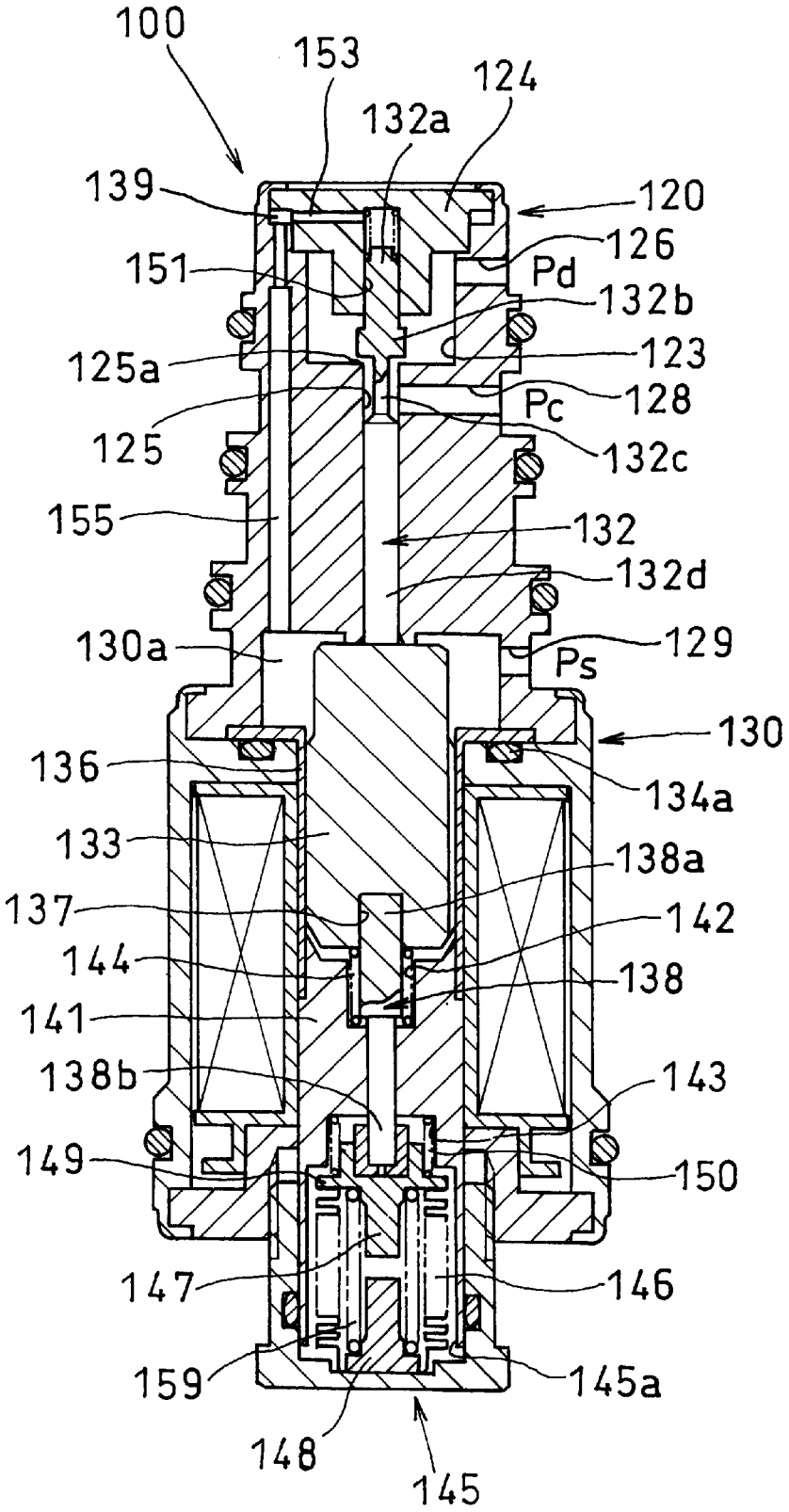
FIG. 3 is a longitudinal sectional view of a control valve for a variable capacity compressor shown in FIG. 2, wherein the control valve is rotated by an angle of 90 degrees.
Figure 4:
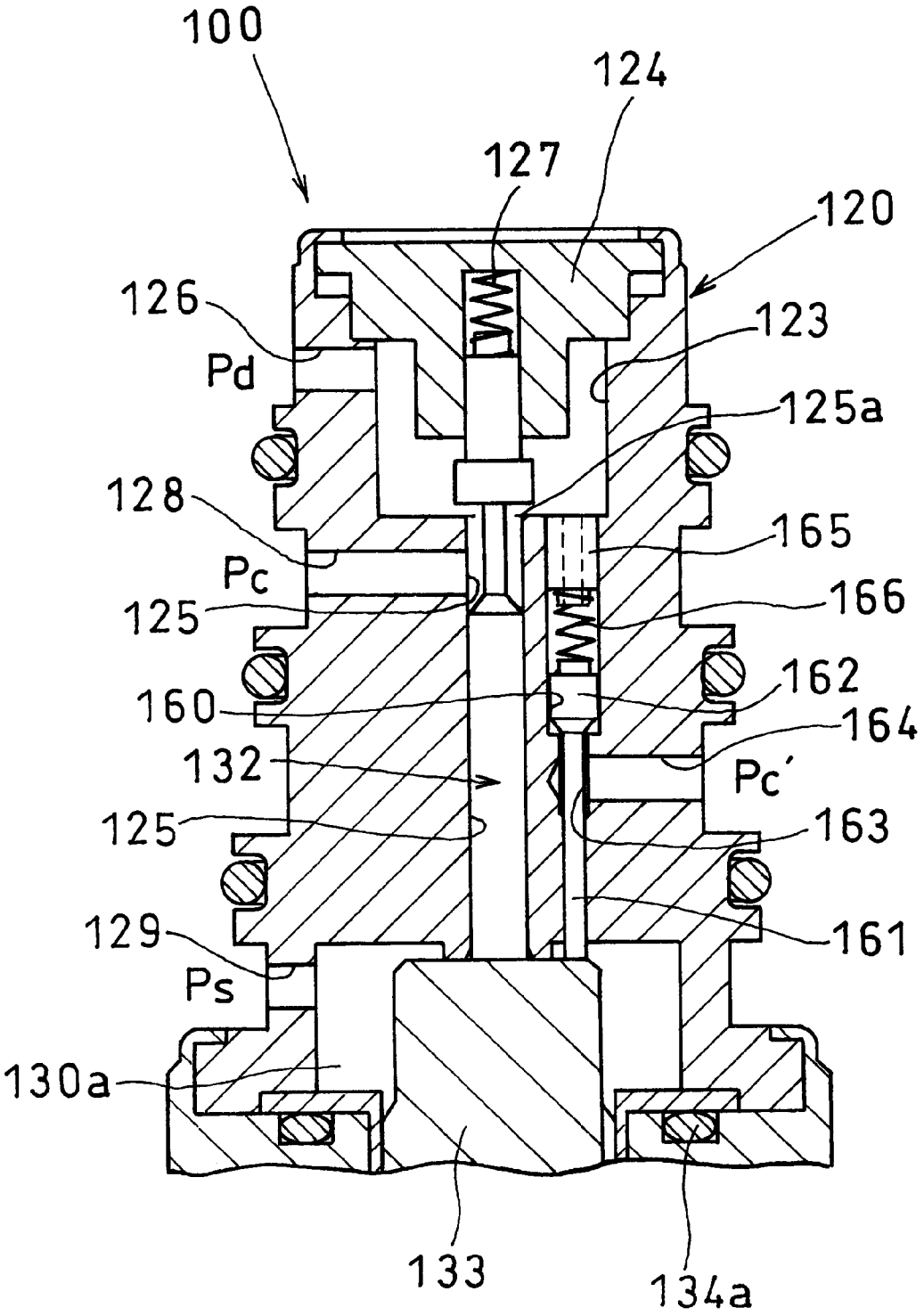
FIG. 4 is an enlarged longitudinal sectional view of the main body of control valve shown in FIG. 1.

FIGS. 1 to 4 illustrate a control valve 100 for a variable capacity compressor (hereinafter referred to simply as a control valve) according to a first embodiment. Specifically, FIG. 1 shows a longitudinal sectional view of a control valve 100 which is incorporated into a variable capacity compressor 1; FIG. 2 shows in detail the control valve 100 of FIG. 1; FIG. 3 shows a longitudinal sectional view wherein the control valve 100 of FIG. 2 is rotated by an angle of 90 degrees; and FIG. 4 shows a partial enlarged longitudinal sectional view of the control valve 100 of FIG. 1.

The control valve 100 shown in FIG. 1 is disposed neighboring on the rear housing 3 of the variable capacity compressor 1 and is airtightly placed inside space 84 of the rear housing 3, the airtightness thereof being effected by means of O-rings 121*a*, 121*b*, 121*c* and 131*b*.

As shown in FIGS. 2 and 3, this control valve 100 is constituted by a main body 120, solenoid magnetization portion 130 and pressure sensitive portion 145, wherein the solenoid magnetization portion 130 is disposed at the center, and the main body 120 and pressure sensitive portion 145 are respectively disposed on both sides of the solenoid magnetization portion 130.

The solenoid magnetization portion 130 is provided on the outer circumference thereof with a solenoid housing 131, in which a solenoid 131A, a plunger 133 to be moved up and down by the magnetization of solenoid 131A, and a suction member 141 are housed. A plunger chamber 130*a* housing the plunger 133 is communicated with a passageway 80 and suction coolant port 129 intersecting one another inside the main body 120.

The pressure sensitive portion 145 is disposed below the solenoid housing 131 and is provided therein with pressure sensitive chamber 145*a*, in which a bellows 146 and a spring 159 which are designed to actuate plunger 133 via a stem 138 are positioned.

The main body 120 is provided with valve chamber 123, and a rod-like first valve 132 to be actuated (opened or closed) by the plunger 133 is disposed inside the valve chamber 123, to which a coolant gas of high discharge pressure Pd can be introduced through a passageway 81 and a discharging coolant-introducing port 126 intersecting one another inside the main body 120. The valve chamber 123 is provided at the bottom surface thereof with a first valve bore 125 communicating with a passageway 57 and also with crankcase coolant port 128 constituting a first intermediate coolant port and intersecting one another inside the main body 120, and the upper space of the valve chamber 123 is closed by means of a stopper 124. This stopper 124 is provided at the central portion thereof with a bottomed vertical pressure chamber 151 having the same cross-sectional area as that of the first valve bore 125 and facing the first valve bore 125. This pressure chamber 151 also functions as a spring housing 151*a* and hence, provided at the bottom portion thereof with valve-closing spring 127 for urging the valve 132 to move toward the bottom side of the valve chamber 123.

The valve 132 is formed of a rod-like body comprising an upper portion 132*a*, an enlarged valve portion 132*b*, a thin diametrical portion 132*c* and a lower portion 132*d*, wherein the upper portion 132*a* and the lower portion 132*d* respectively has the same sectional area as that of the first valve bore 125, the upper portion 132*a* is fittingly supported by the stopper 124 provided with a pressure chamber 151, the enlarged valve portion 132*b* is disposed inside the valve chamber 123, the thin diametrical portion 132*c* disposed inside the first valve bore 125 intersects with the crankcase coolant port 128 communicating with the crankcase (crankcase pressure Pc, which constitutes the first immediate pressure region) of the compressor 1, and the lower portion 132*d* is fitted in and supported by main body 120 and the distal end of the lower portion 132*d* is introduced into a plunger chamber 130*a* of the solenoid magnetization portion 130 into which a coolant gas of suction pressure Ps is to be introduced, thereby enabling the distal end of the lower portion 132*d* to be contacted with the plunger 133. When the plunger 133 is moved up and down, the valve 132 is caused to move up and down, thereby enabling it to adjust the gap between this enlarged valve portion 132*b* and the valve seat 125*a* on the top surface of the first valve bore 125.

Furthermore, the main body 120 is provided also with a second valve chamber 160, in which a second valve 162 to be opened or closed by the movement of a push rod 161 interlocking with the movement of the plunger 133 is disposed. The second valve chamber 160 is provided at the bottom surface thereof with a second valve bore 163 communicating with a second intermediate pressure region (intermediate pressure Pc') of the compressor 1 in contrast to the crankcase of the compressor 1, thereby enabling a coolant gas of high discharge pressure Pd to be introduced not only into the crankcase coolant port 128 through the discharge coolant port 126, but also into the aforementioned intermediate pressure region through the second valve bore 163 and the second intermediate coolant port 164 (FIG. 4).

A valve-closing spring 166 for urging the valve 162 to move toward the bottom of the valve chamber 160 through a stopper 165 is provided in an upper space of the valve chamber 160, so that the second valve 162 is enabled, through the interlocking of the first valve 132 with the plunger 133, to close the discharge coolant port 126 and the second intermediate coolant port 164 which are communicated with the discharge pressure region before the discharge coolant port 126 and the crankcase coolant port 128 are closed.

As shown in FIG. 3, the stopper 124 is provided with a lateral bore 153 communicating with the pressure chamber 151. Due to this lateral bore 153, the space 139 defined by the stopper 124 and the main body 120 is enabled to communicate with the pressure chamber 151. On the other hand, the main body 120 is provided with a cancel bore 155 for enabling the space 139 to be communicated with the plunger chamber 130*a* of the solenoid magnetization portion 130 into which a coolant gas of suction pressure Ps is introduced.

Therefore, the coolant gas of suction pressure Ps in the plunger chamber 130*a* can be guided via this cancel bore 155 to the pressure chamber 151, thereby causing the valve 132 to receive the suction pressure Ps from both upper and lower portions valve 132*a* and 132*d*. In this case, since the upper and lower portions valve 132*a* and 132*d* of the valve 132 are the same in cross-sectional area, the suction pressure Ps given from both upper and lower portions valve 132*a* and 132*d* is balanced or offset, thus rendering the valve 132 substantially free from the influence of the discharge pressure Pd. Further, since the valve 132 is constructed such that the portion thereof positioned in the vicinity of the crankcase coolant port 128 communicating with the crankcase of the compressor 1 having a crankcase inner pressure Pc is constituted by the thin diametrical portion 132*c*, even if the pressure Pc inside the crankcase is given thereto under the condition where the valve portion 132*b* of valve 132 is seated on the valve seat 125*a*, the forces from both sides are balanced, thus rendering the valve 132 free from any unnecessary force.

The low temperature suction pressure Ps that has been introduced into the plunger chamber 131*a* is then lead not only to the pressure sensitive portion 145 but also to the suction pressure-introducing space 85 formed between the rear housing 3 and the solenoid housing 131 (FIG. 1). In this case, since the suction pressure-introducing space 85 is air-tightly closed through the O-ring 131*b* placed on the sidewall of the solenoid housing 131, the sidewall of the solenoid housing 131 can be cooled entirely by this low temperature coolant gas being fed from the suction pressure region.

As shown in FIG. 3, the plunger 133 linked and fixed to the valve 132 is disposed inside the solenoid housing 131 and slidably sustained in a pipe 136 which is closely contacted via one O-ring 134*a* with one end of the solenoid housing 131. The plunger 133 is provided at the rear end portion thereof with an accommodating hole 137, into which an upper end 138*a* of the stem 138 is inserted and fastened. The lower end 138*b* of the stem 138 is slidably sustained by the suction member 141 and extended from the fore-accommodating bore 142 of the suction member 141 to a place ahead of the rear-accommodating bore 143 of the suction member 141. Between the plunger 133 and the fore-accommodating bore 142 of the suction member 141, there is disposed a valve opening spring 144 for urging the plunger 133 to move away from the suction member 141.

Among a pair of stoppers 147 and 148 disposed inside the bellows 146 arranged inside pressure sensitive chamber 145*a*, only the stopper 147 is attached to the lower end 138*b* of the stem 138, thereby enabling the stopper 147 to move close to or away from the stopper 148. Additionally, a spring 150 for urging the stopper 147 to move away from the suction member 141 is interposed between the stopper 147 and the suction member 141.

The displacement of the bellows 146 is designed to be restricted by the contact between this pair of stoppers 147 and 148 as the suction pressure Ps of the pressure sensitive chamber 145*a* is increased and hence, the bellows 146 is shrunk. In this case, the maximum displacement of the bellows 146 is set to such that it becomes smaller than the maximum magnitude of engagement between the lower end 138*b* of the stem 138 and the stopper 147 of the bellows 146. By the way, a cord 158 for supplying a predetermined magnetization current that will be controlled by a controlling computer (not shown) is connected with the solenoid 131A.

The rotational driving force of engine mounted on a vehicle can be continuously transmitted, through a belt, from the pulley to the shaft of the compressor 1, and due to the torque of shaft, the wobble plate of the compressor 1 is cause to rotate. This rotation of wobble plate is then converted into the linear reciprocating motion of the piston of the compressor 1, thereby changing the capacity, under which conditions the intake, compression and discharge of a coolant gas is successively performed, thus discharging a coolant gas.

When thermal load is increased, the angle of inclination of the wobble plate is increased, thus increasing the pressure difference between the discharge pressure region and the crankcase higher than a predetermined value. As a result, the solenoid 131A of the control valve 100 is magnetized, and the plunger 133 is pulled toward the suction member 141. In this case, since the push rod 161 is interlocked with the plunger 133, the second valve 162 which is linked to the push rod 161 is caused to move in the direction to close the second valve bore 163 due to a pressure difference (Pd−Pc') between the discharge coolant port 126 and the second intermediate coolant port 164 and also to the urging force of the valve-closing spring 166, thus preventing the coolant gas from entering into the second intermediate pressure region. Subsequently, when the plunger 133 is further pulled toward the suction member 141, the first valve 132 linked to the plunger 133 is caused to move in the direction to close the first valve bore 125, thus preventing the coolant gas from entering into the crankcase.

On the other hand, the low temperature coolant gas is guided from the passageway 80 communicated with the suction pressure region to the pressure sensitive portion 145 through the suction coolant port 129 and the plunger chamber 130*a* of the main body 120. The bellows 146 of the pressure sensitive portion 145 is caused to displace depending on the pressure of the coolant gas or the suction pressure Ps of the suction pressure region, the resultant displacement being immediately transmitted to the valve 132 through the stem 138 and the plunger 133. Namely, the degree of opening of the valve 132 relative to the first valve bore 125 will be determined by the sucking force of solenoid 131A, by the urging force of the bellows 146 and by the urging force of the valve-closing spring 127 and of valve-opening spring 144.

When the pressure (suction pressure Ps) of the interior of the pressure sensitive chamber 145a becomes high, the bellows 146 is contracted. Since the direction of this contraction agrees with the sucking direction of the plunger 133 to be effected by the solenoid housing 131, the valve 132 is caused to follow the displacement of the bellows 146, thus reducing the opening degree of the first valve bore 125. As a result, the quantity of a high pressure coolant gas to be introduced into the interior of the valve chamber 123 from the discharge region is reduced (the pressure Pc of the crankcase is lowered), thus increasing the inclination angle of the wobble plate.

On the other hand, when the pressure inside the pressure sensitive chamber 145*a* is lowered, the bellows 146 is expanded due to the spring 159 and to the restoring force of the bellows 146 itself. As a result, the valve 132 is caused to move in the direction to increase the opening degree of the first valve bore 125. As a result, the quantity of a high pressure coolant gas to be introduced into the interior of the valve chamber 123 is increased (the pressure Pc of the crankcase is raised), thus decreasing the inclination angle of the wobble plate.

Whereas, when the thermal load becomes smaller, a high-pressure coolant gas flows from the discharge pressure region into the crankcase, thus increasing the pressure in the crankcase and minimizing the angle of inclination of the wobble plate.

When the pressure difference between the discharge pressure region and the crankcase becomes below a predetermined value, the solenoid 131A is demagnetized, the pulling of the plunger 133 is vanished, so that the second valve 162 connected with the push rod 161 is caused to move, against the urging force of the valve-opening spring 166, in the direction to open the second valve bore 163, thereby promoting the inflow of the coolant gas into the second intermediate pressure region. At the same time, due to the urging force of the valve-opening spring 144, the plunger 133 is caused to move away from the suction member 141, and at the same time, the valve 132 is moved in the direction to open the first valve bore 125 of the main body 120, thereby promoting the inflow of the coolant gas into the crankcase.

When the pressure of the interior of the pressure sensitive portion 145 is increased under this condition, the bellows 146 is caused to contract thereby decreasing the opening degree of the valve 132. However, since the lower end 138*b* of the stem 138 is detachably contacted with the stopper 147 of the bellows 146, this displacement of the bellows 146 would not give any influence to the valve 132.

Figure 5:
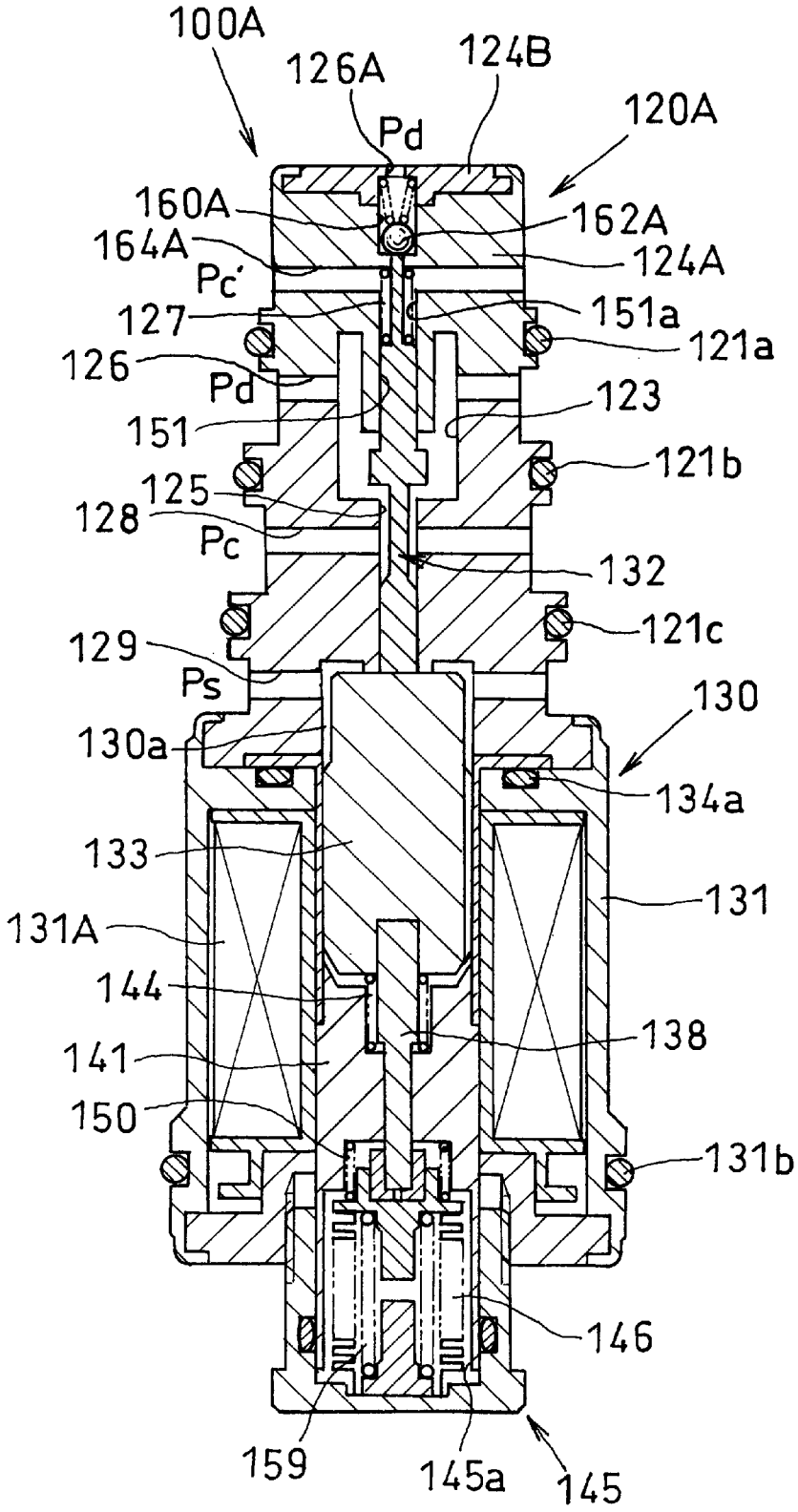
FIG. 5 is a longitudinal sectional view shown in detail of a control valve for a variable capacity compressor according to a second embodiment of the present invention.
Figure 6:
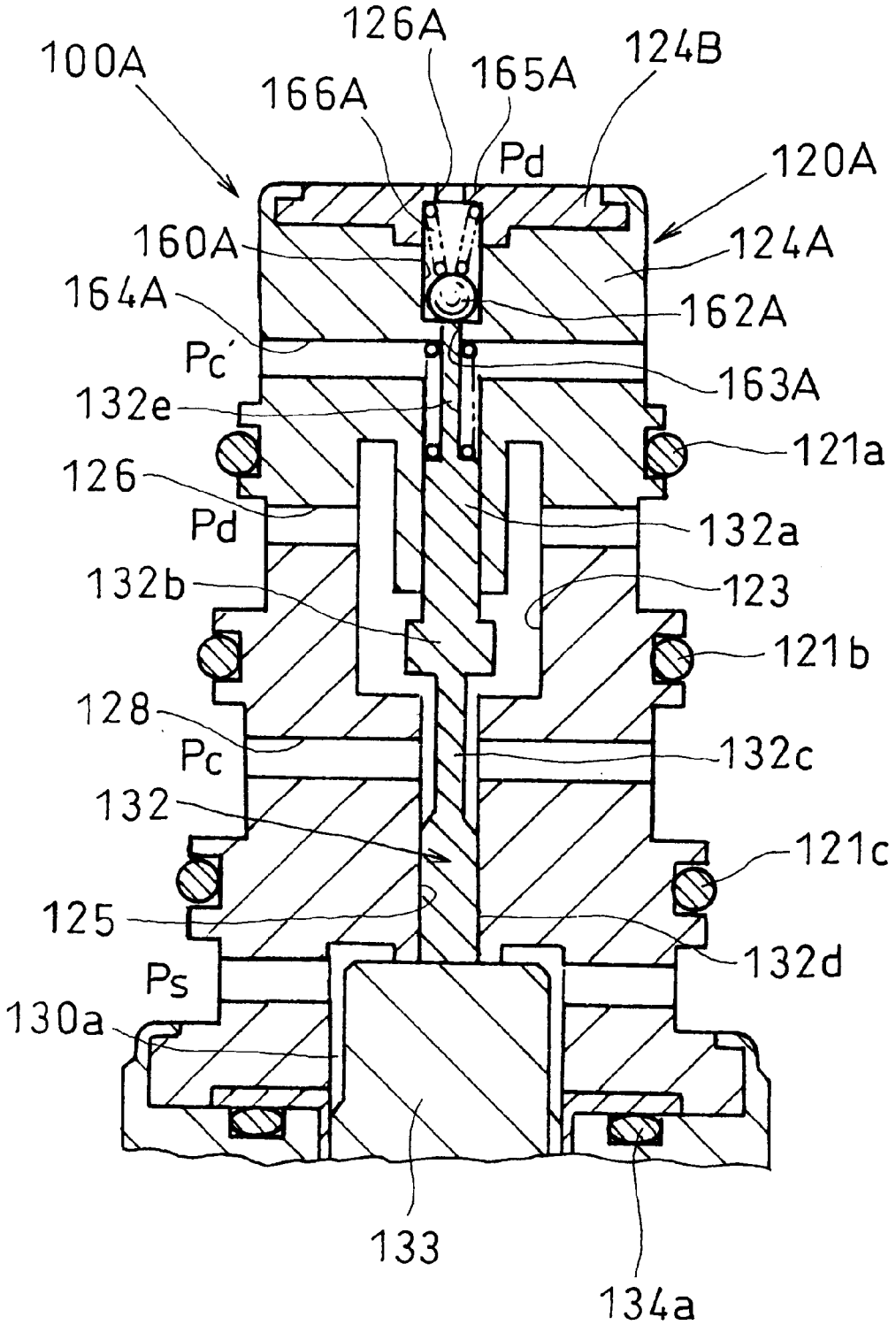
FIG. 6 is an enlarged longitudinal sectional view of the main body of control valve shown in FIG. 5.

FIGS. 5 and 6 illustrate a control valve 100A according to a second embodiment, wherein the construction of the control valve 100A is substantially the same as that of the control valve 100 of the aforementioned first embodiment except that the location of the second intermediate coolant port is altered. Therefore, this modified feature will be mainly explained in detail as follows.

Specifically, FIG. 5 shows a longitudinal sectional view of a control valve 100A; and FIG. 6 shows a partial enlarged longitudinal sectional view of the control valve 100A of FIG. 5.

This control valve 100A is constituted by a main body 120A, solenoid magnetization portion 130 and pressure sensitive portion 145, wherein the main body 120A is provided with valve chamber 123, and a rod-like first valve 132 to be actuated (opened or closed) by the plunger 133 is disposed inside the valve chamber 123, to which a coolant gas of high discharge pressure Pd is designed to be introduced through a discharging coolant-introducing port 126. The valve chamber 123 is provided at the bottom surface thereof with a first valve bore 125 communicating with a crankcase coolant port 128, etc. and the upper space of the valve chamber 123 is closed by means of a first stopper 124A and a second stopper 124B.

This first stopper 124A is provided at the central portion thereof with a bottomed vertical pressure chamber 151 having the same cross-sectional area as that of the first valve bore 125 and facing the first valve bore 125, and also with a second valve chamber 160A at a location which faces the pressure chamber 151. This pressure chamber 151 also functions as a spring housing 151*a* and hence, provided at the bottom portion thereof with valve-closing spring 127 for urging the valve 132 to move toward the bottom side of the valve chamber 123.

The valve 132A is formed of a rod-like body comprising an engageable rib portion 132*e*, an upper portion 132*a*, an enlarged valve portion 132*b*, a thin diametrical portion 132*c* and a lower portion 132*d*, wherein the upper portion 132*a* and the lower portion 132*d* respectively has the same sectional area as that of the first valve bore 125, the upper portion 132*a* is fittingly supported by the first stopper 124A provided with a pressure chamber 151, and the engageable rib portion 132*e* to be engaged with and supported by the second valve bore 163A is positioned over the upper portion 132*a*.

Inside this second valve chamber 160A, there is disposed, via the first valve 132 interlocked with the movement of the plunger 133, a spherical second valve 162A to be opened or closed through the contact thereof with the engageable rib portion 132*e*. The second valve chamber 160A is provided at the bottom surface thereof with a second valve bore 163A communicating with a second intermediate pressure region (intermediate pressure Pc') of the compressor 1 in contrast to the crankcase of the compressor 1, thereby enabling a coolant gas of high discharge pressure Pd to be introduced not only into the crankcase coolant port 128 through the discharge coolant port 126, but also into the aforementioned intermediate pressure region through the coolant-introducing bore 126A communicating with the discharge pressure region, the second valve bore 163A and the second intermediate coolant port 164A.

A valve-closing spring 166A for urging the valve 162A to move toward the bottom of the valve chamber 160A through a spring stopper 165A (placed inside the second stopper 124B) is provided in an upper space of the valve chamber 160A, so that the second valve 162A is enabled to close the discharge coolant port 126A and the second intermediate coolant port 164A which are communicated with the discharge pressure region before the discharge coolant port 126 and the crankcase coolant port 128 are closed by the first valve 132.

When the solenoid 131A of the control valve 100A is magnetized and the plunger 133 is pulled toward the suction member 141, the second valve 162A which is contacted with the first valve 132 interlocked with the plunger 133 is caused to move in the direction to close the second valve bore 163A due to a pressure difference (Pd−Pc') between the coolant-introducing port 126A and the second intermediate coolant port 164A and also to the urging force of the valve-closing spring 166A, thus preventing the coolant gas from entering into the second intermediate pressure region. Subsequently, when the plunger 133 is further pulled toward the suction member 141, the first valve 132 linked to the plunger 133 is caused to move in the direction to close the first valve bore 125, thus preventing the coolant gas from entering into the crankcase.

Whereas, when the thermal load becomes smaller, a high-pressure coolant gas flows from the discharge pressure region into the crankcase, thus increasing the pressure in the crankcase and minimizing the angle of inclination of the wobble plate.

When the pressure difference between the discharge pressure region and the crankcase becomes below a predetermined value, the solenoid 131A is demagnetized, the pulling of the plunger 133 is vanished, so that the second valve 162A contacted with the first valve 132 is caused to move, against the urging force of the valve-opening spring 166A, in the direction to open the second valve bore 163A, thereby promoting the inflow of the coolant gas into the second intermediate pressure region. At the same time, due to the urging force of the valve-opening spring 144, the plunger 133 is caused to move away from the suction member 141, and at the same time, the valve 132 is moved in the direction to open the first valve bore 125 of the main body 120, thereby promoting the inflow of the coolant gas into the crankcase.

Being constructed as explained above, the aforementioned embodiments of the present invention are featured to have the following functions.

Namely, the control valve 100 of the first embodiment and the control valve 100A of the second embodiment are featured in that they comprise a centrally located solenoid magnetization portion 130 provided with a plunger 133 enabled to move up and down by the magnetization of the solenoid 131A, a pressure sensitive portion 145 disposed below the solenoid magnetization portion 130 and provided with bellows 146 which is enabled to interlock via the stem 138 with the plunger 133, and the main body 120 (120A) provided with the valve chamber 123 in which the valve 132 enabled to interlock with the plunger 133 is disposed over the solenoid housing 131; wherein the main body 120 (120A) comprises a discharge coolant port 126 communicating with a discharge pressure region of the variable capacity compressor 1, a first intermediate coolant port 128 communicating with a first intermediate pressure region, a suction coolant port 129, and a second intermediate coolant port 164 (164A) communicating with a second intermediate pressure region of the variable capacity compressor 1. Additionally, the main body 120 (120A) may comprise a first valve 132 for opening or closing the discharge coolant port 126 (126A) and the first intermediate coolant port 128, a second valve 162 (162A) for opening or closing the discharge coolant port 126 (126A) and the second intermediate coolant port 164 (164A), and a valve chamber 123 having a first valve bore 125 at the bottom surface thereof; wherein the first valve 132 is enabled to be actuated by the plunger 133 of the solenoid magnetization portion 130 disposed inside the valve chamber 123, and the second valve 162 (162A) is also enabled to move with the movement of the plunger 133, so that the second valve 162 (162A) is enabled to close the discharge coolant port 126 (126A) and the second intermediate coolant port 164 (164A) before the discharge coolant port 126 and the first intermediate coolant port 128 are closed by the first valve 132.

Figure 7A:
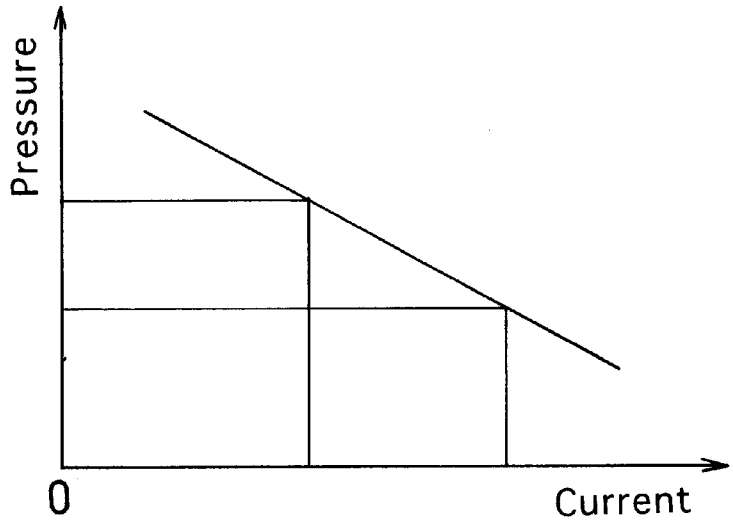
FIG. 7A is a graph illustrating the operational characteristic of the control valves shown in FIGS. 1 and 5; and FIG.
Figure 7B:
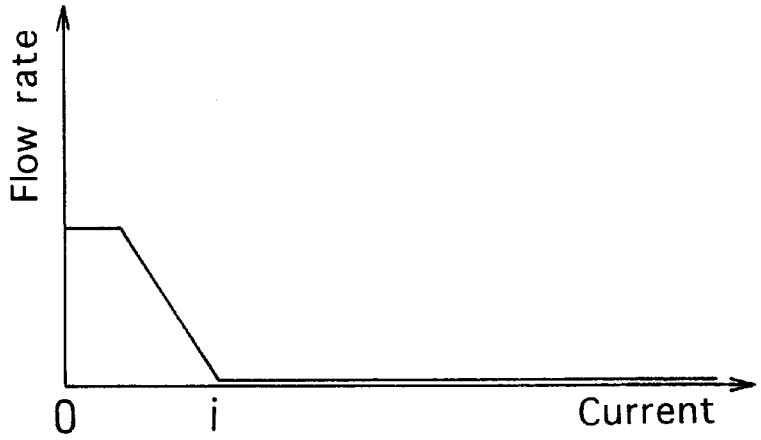
Figure 8:
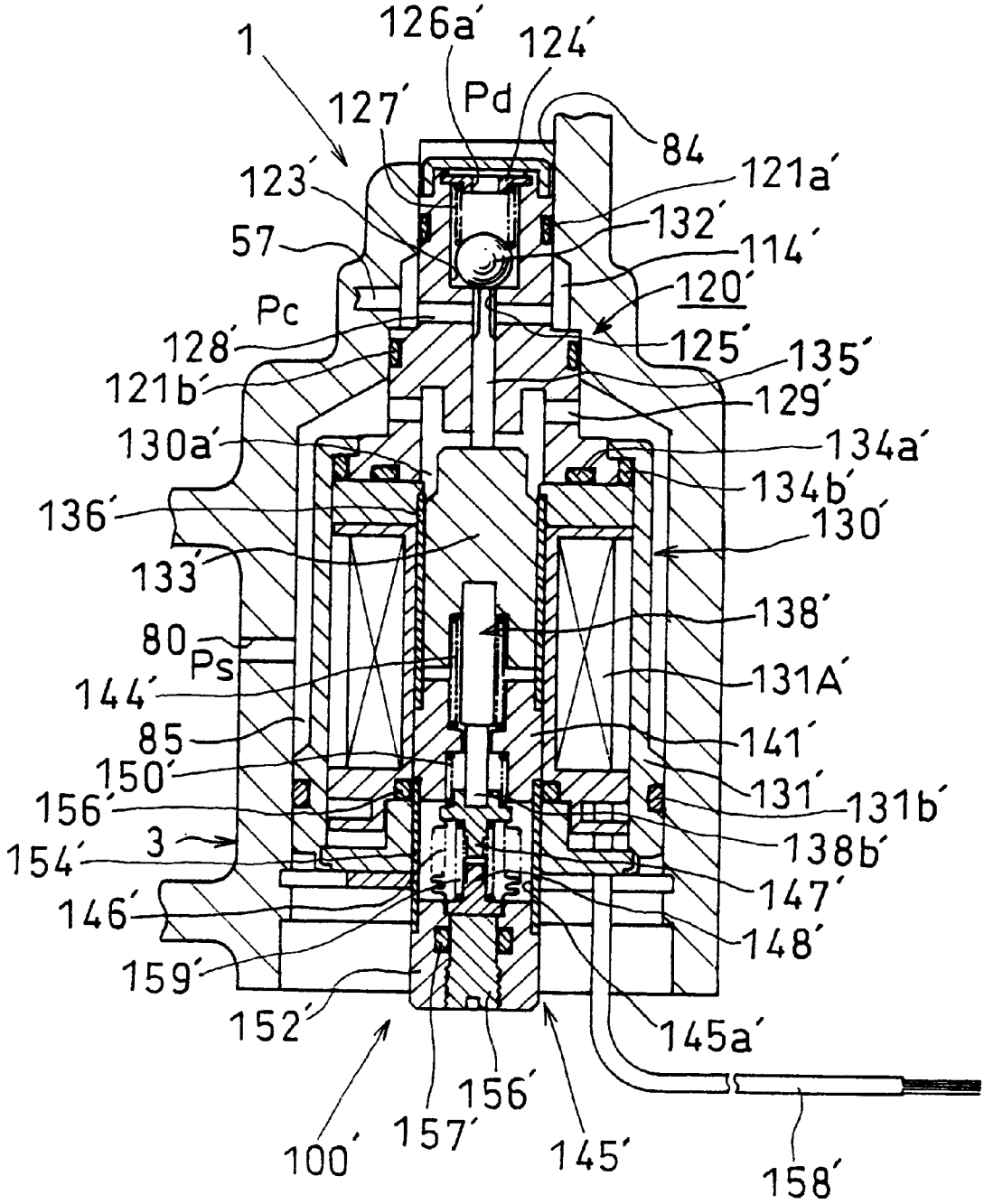
FIG. 8 is a longitudinal sectional view of a variable capacity compressor of prior art, which is provided with a conventional control valve.

Therefore, as shown in the graph of FIG. 7A illustrating the operational characteristics of the control valve 100 (100A) by way of pressure and current, it is possible to ensure the same degree of operational characteristics as those of the conventional control valve. Additionally, as shown in the graph of FIG. 7B illustrating the flow rate characteristics of the control valve 100 (100A) by way of flow rate and current, it is possible to obtain a different flow rate characteristics from that of the conventional control valve, thereby making it possible to introduce a high discharge pressure Pd of coolant gas into a second intermediate pressure region, i.e. it is made possible by the effect of the second valve 162 (162A), when the valve is fully opened (the current=0), to reliably secure a required quantity of flow rate in this second intermediate pressure region. Furthermore, since it is possible to substantially inhibit the flow rate of coolant gas to the second intermediate pressure region when the valve is completely closed (the current=i), it is possible to reliably respond to the demand for the effective utilization of not only a pressure difference between the high discharge pressure Pd and the first intermediate pressure Pc but also a pressure difference between the high discharge pressure Pd and the second intermediate pressure Pc'.

According to the control valve 100 of the first embodiment as well as according to the control valve 100A of the second embodiment, since the solenoid magnetization portion 130 and the main body 120 (120A) of control valve are assembled in such a way that the plunger 133 linked and fixed to the valve 132 is slidably sustained by the pipe 136 which is closely contacted via one O-ring 134*a* with one end of the solenoid housing 131, even if the configuration of the main body 120 (120A) is enlarged due to an additional attachment of the aforementioned second intermediate coolant port 164 (164A) for instance, the number of O-ring can be confined to almost the same degree as that of conventional control valve, i.e. the number of O-ring can be substantially reduced in the assembling of the solenoid magnetization portion 130 and the main body 120 (120A). Therefore, it is possible according to the present invention to reduce the manufacturing cost of the control valve through the reduction of the number of parts required for the control valve 100 (100A).

As explained above, since the control valve for a variable capacity compressor according to the present invention is provided with a second intermediate coolant port which is communicated with,the second intermediate pressure region of variable capacity compressor, and with a second valve for opening or closing the second intermediate coolant port and the discharge pressure region, it is now possible to introduce a discharge pressure from a variable capacity compressor not only into a first intermediate pressure region, but also into a second intermediate pressure region, thereby making it possible to effectively utilize also a difference in pressure between a high discharge pressure and an intermediate pressure.

What is claimed is:

1. A control valve for a variable capacity compressor, which comprises a solenoid magnetization portion disposed at a central portion, a main body disposed on one side of said solenoid magnetization portion, and a pressure sensitive portion disposed on the other side of said solenoid magnetization portion;

wherein said main body comprises a discharge coolant port communicating with a discharge pressure region of said variable capacity compressor, a first intermediate coolant port communicating with a first intermediate pressure region, a suction coolant port communicating with a suction pressure region, and a second intermediate coolant port communicating with a second intermediate pressure region of said variable capacity compressor.

2. The control valve for a variable capacity compressor according to claim 1, wherein said main body comprises a first valve for opening or closing communication between said discharge coolant port and said first intermediate coolant port, and a second valve for opening or closing communication between said discharge pressure region and said second intermediate coolant port.

3. The control valve for a variable capacity compressor according to claim 2, wherein said main body further comprises means for closing said second valve, to thereby close communication between said discharge pressure region and said second intermediate coolant port before said discharge coolant port and said first intermediate coolant port are closed by said first valve.

4. The control valve for a variable capacity compressor according to claim 1 or 3, wherein the main body further comprises a valve chamber having a valve bore at the bottom surface thereof; said first valve is disposed inside said valve chamber for coaction with said valve bore; said solenoid magnetization portion includes a plunger, said plunger being movable by said solenoid magnetization portion to actuate said first valve; and said second valve being actuated following the movement of said plunger which actuates said first valve.

* * * * *